US012240024B2

(12) United States Patent
Venuti et al.

(10) Patent No.: US 12,240,024 B2
(45) Date of Patent: Mar. 4, 2025

(54) METHOD AND APPARATUS TO CONTROL AND ADJUST THE DRAWING ACTION IN A ROLLING MILL, AND CORRESPONDING ROLLING MILL

(71) Applicants: Danieli & C. Officine Meccaniche S.p.A., Buttrio (IT); Danieli Automation S.P.A., Buttrio (IT)

(72) Inventors: Andrea Venuti, Gemona del Friuli (IT); Marco Conti, Via Nazionale (IT)

(73) Assignees: Danieli & C. Officine Meccaniche S.p.A., Buttrio (IT); Danieli Automation S.P.A., Buttrio (IT)

( * ) Notice: Subject to any disclaimer, the term of this patent is extended or adjusted under 35 U.S.C. 154(b) by 211 days.

(21) Appl. No.: 17/923,492

(22) PCT Filed: May 4, 2021

(86) PCT No.: PCT/IT2021/050131
§ 371 (c)(1),
(2) Date: Nov. 4, 2022

(87) PCT Pub. No.: WO2021/224950
PCT Pub. Date: Nov. 11, 2021

(65) Prior Publication Data

US 2023/0182186 A1 Jun. 15, 2023

(30) Foreign Application Priority Data

May 6, 2020 (IT) ..... 102020000010147

(51) Int. Cl.
*B21B 38/04* (2006.01)
*B21B 37/00* (2006.01)
(Continued)

(52) U.S. Cl.
CPC ..... *B21B 38/04* (2013.01); *B21B 37/58* (2013.01); *B21B 37/68* (2013.01); *B21B 38/008* (2013.01);
(Continued)

(58) Field of Classification Search
CPC ..... B21B 38/04; B21B 38/008; B21B 38/00; B21B 37/58; B21B 37/68; B21B 2273/02;
(Continued)

(56) References Cited

U.S. PATENT DOCUMENTS 6,349,581 B1 * 2/2002 Palzer ..... B21B 37/52 72/8.6
8,919,162 B2 * 12/2014 Moretto ..... B21B 37/68 72/11.1
2010/0269556 A1 10/2010 Moretta et al.

FOREIGN PATENT DOCUMENTS

EP 2 283 942 8/2009
JP S63144813 A 6/1988
KR 100 929 017 B1 11/2009

OTHER PUBLICATIONS

International Search Report and Written Opinion issued Sep. 1, 2021 in PCT/IT2021/050131.

* cited by examiner

*Primary Examiner* — Mohammed S. Alawadi
(74) *Attorney, Agent, or Firm* — Panitch Schwarze Belisario & Nadel LLP

(57) ABSTRACT

Apparatus to control and adjust the drawing action in a rolling mill provided with rolling stands through which a product passes. A video monitoring system acquires frames of the product; a processing system that processes the frames and defines a normal rolling range within which the product being rolled must be positioned; identifies the position of the product and its geometric characteristics; and identifies a
(Continued)

possible variation of the position of the product being rolled over time based on the analysis of the sequence of frames acquired. An automation system is associated with the rolling mill, configured to receive data relating to the position of the product to determine the continuation of the rolling if the product is correctly positioned in the range, or a variation of the rolling parameters if the position of the product being rolled is able to generate a cobble which is outside of the range.

16 Claims, 3 Drawing Sheets

(51) Int. Cl.

| | |
|---|---|
| ***B21B 37/52*** | (2006.01) |
| ***B21B 37/58*** | (2006.01) |
| ***B21B 37/68*** | (2006.01) |
| ***B21B 38/00*** | (2006.01) |
| ***B21C 51/00*** | (2006.01) |

(52) U.S. Cl.
CPC ..... *B21C 51/00* (2013.01); *B21B 2273/02* (2013.01); *B21B 2273/04* (2013.01)

(58) Field of Classification Search
CPC ..... B21B 2273/04; B21B 37/00; B21B 37/52; B21B 2265/06; B21C 51/00
See application file for complete search history.

Vg1<Vg2<Vg3

Vg1<Vg2<Vg3

Vg1<Vg2<Vg3

METHOD AND APPARATUS TO CONTROL AND ADJUST THE DRAWING ACTION IN A ROLLING MILL, AND CORRESPONDING ROLLING MILL

CROSS-REFERENCE TO RELATED APPLICATIONS

This application is a Section 371 of International Application No PCT/IT2021/050131, filed May 4, 2021, which was published in the English language on Nov. 11, 2021, under International Publication No. WO 2021/224950 A1, which claims priority under 35 U.S.C. § 119 (b) to Italian Application No. 102020000010147, filed May 6, 2020, the disclosures of each of which are incorporated herein by reference.

FIELD OF THE INVENTION

The present invention concerns a method and an apparatus to control and adjust the drawing action in a rolling mill, in particular in a continuous rolling mill comprising a plurality of rolling stands disposed in sequence.

BACKGROUND OF THE INVENTION

As is known, in a continuous rolling mill cobble is the situation that occurs when the material coming out from one rolling stand does not flow correctly into the next rolling stand. This can result in the accumulation of the rolled product between the rolling stands themselves, with the risk that it can exit from the rolling line in an unpredictable and potentially dangerous way.

The consequences of cobbles, in addition to stopping the rolling line, are a risk to the integrity of the equipment of the line itself, as well as a risk to the safety of the operators.

Cobble at the entrance of the rolled product into a rolling stand is generally due to an incorrect ratio between the flow rates of the material in transit between the rolling stands, wherein by flow rate we mean the product of the speed of the rolling rolls of a stand and the section of the material at each rolling pass, or to the variations in the drawing action between the rolling stands during rolling.

During rolling, various factors can change the drawing action between the rolling stands, such as, for example, a variation in the temperature of the product along its length or a change in the degree of wear of the rolling channels. This last factor determines the arrival in the subsequent rolling stands of a product with a larger section than the size of the rolling channels that have to receive and process it. The variation in flow rate between the rolling passes reduces the drawing action between the rolling stands, and when this variation becomes excessive it leads to blocking.

If the drawing action is correctly implemented and maintained between the different passes, the material proceeds linearly without oscillations, thinning correctly at each pass according to the pre-established rolling specifications.

In order to at least partly limit the effects of cobbles, in various plants the riskiest rolling passes have begun to be confined to special caissons, thus limiting the movements of the material in the event of cobble. However, this does not prevent damage to parts of the machines themselves, for example the guide boxes which carry the product from one rolling stand to the next; furthermore, this confinement prevents an effective visual check by the operators of what is really happening in the various covered segments of the line.

To try to further limit the damage on the machines contained in the caissons, it is common practice to insert a "spider web" of metal wire in the free spaces of the machine. The wire of the spider web is manually attached by the operators in different points of the machine and is connected to an emergency system. When cobble occurs and the accumulated material cuts the wire, the line is put on emergency. In this case, the material upstream begins to be scrapped and the rolling stands in which the blocking occurs are stopped, so as to limit the damage.

The operators therefore have to intervene manually to free the line from cobble, restore it to start working again, fix the alignments and reinstall the spider web. This clearly has high costs in terms of lost production.

Document JP63144813A describes a device to prevent cobble in a rolling mill for long products, which provides to adjust the speeds of the rolling rolls to prevent long products from oscillating in the inter-stand segments. In particular, the solution described in JP63144813A provides to monitor the product by means of video devices, detecting possible deformations thereof and comparing them with bands of minimum and maximum values in order to consequently adjust the rotation speeds of the rolling rolls. This solution in practice performs a continuous control of the product being rolled based on bands of alarm values and, even if it allows to identify potential problems of blocking, it does not allow to carry out a correct and precise adjustment of the inter-stand drawing action of the long products in order to prevent such problems from occurring.

Document KR100929017A concerns a method and an apparatus to predict a possible fracture of a flat product in an inter-stand segment of a cold rolling mill, based on calculations derived from a measurement of a vibration generated by the plate itself and detected by means of a suitable sensor and comparison with corresponding parameters in a normal rolling condition.

Document US2010/0269556A1 describes a rolling method for flat products which provides to detect, by means of video devices, the position of the flat product with respect to the rolling rolls in order to correct its position and align it in correspondence with the center of the rolls.

EP2283942A1 describes a method to control the positioning of a flat product with respect to a central zone of the rolling rolls, which provides to detect the position of the flat product by means of a video device and to adjust the position of the flat product with respect to the rolling rolls by means of an additional actuator without necessarily influencing the adjustment of the rolling rolls.

There is therefore a need to perfect a method and an apparatus to control and adjust the drawing action in a rolling mill which can overcome at least one of the disadvantages of the state of the art.

In particular, one purpose of the present invention is to provide an apparatus to control and adjust the drawing action in a rolling mill which can automatically obtain an optimal condition of the drawing action during the rolling process so as to prevent possible blocking of the products being rolled.

Another purpose of the invention is to provide a control and adjustment apparatus which can automatically detect the condition of the product being rolled in any position of the rolling mill whatsoever, which can verify, quickly and effectively, if there are any risks of blocking for the product being rolled and can transmit the data to the automation system of the rolling mill.

Another purpose is to provide a control and adjustment apparatus of the drawing action in a rolling mill which is simple and economical.

Another purpose is to provide an apparatus which, in the event of a risk of cobble, can automatically correct one or more of the rolling parameters, for example the revolutions of the motors that drive the rolling rolls and gaps between the rolls themselves, in order to modify the drawing action.

Another purpose is to provide an apparatus to control and adjust the drawing action in a rolling mill which allows to safeguard the safety of the operators, limiting manual operations as much as possible, if not eliminating them, and which allows a constant display of the rolling process so as to identify possible risks or potential critical issues of the process.

Yet another purpose of the present invention is to provide an apparatus to control and adjust the drawing action in a rolling mill which allows to contain production costs, and drastically reduces the need to stop the rolling plant, thanks above all to the possibility of verifying the condition of the product being rolled, thus allowing to intervene in advance in the event of the risk of cobble, and which is ultimately simple and economical to make.

Another purpose of the present invention is to perfect an efficient, simple and economical method to control and adjust the drawing action in a rolling mill The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, the present invention concerns an apparatus to control and adjust the drawing action in a rolling mill provided with a plurality of rolling stands located in sequence, through which a product being rolled passes in a direction of rolling.

In particular, the products being rolled can be long products, for example billets, blooms, wire rods, rods, bars.

According to one aspect of the invention, the present apparatus comprises:

- a video monitoring system for acquiring a sequence of frames of the product being rolled in at least one position along the rolling mill;
- a processing system connected to the video monitoring system and configured to:

carry out the processing of the sequence of frames and define in the sequence of frames acquired at least one normal rolling range within which the product being rolled has to be positioned in situations of normal rolling;

- identify the position of the product being rolled and its geometric characteristics;
- identify a possible oscillation of the product being rolled as a function of a variation of the position of the product being rolled over time based on the analysis of the sequence of frames acquired;
- an automation system associated with the rolling mill, connected to the processing system and configured to determine an optimal condition of the drawing action for the product being rolled, corresponding to a condition of minimum oscillation of the product being rolled in at least one inter-stand segment and to receive the data relating to the position of the product being rolled and the possible variation of position of the product being rolled, so as to be able to determine the continuation of the rolling if the product is correctly positioned in the normal rolling range, or a possible variation of the rolling parameters if the position of the product being rolled is potentially able to generate a cobble, that it, it is outside of the range, in order to maintain or restore an optimal condition of the drawing action for the product being rolled in the at least one inter-stand segment.

According to some embodiments, the automation system is configured to apply timed and controlled accelerations and decelerations on the rolls of the rolling stands in order to induce a set and controlled vibration on the product being rolled and determine the optimal condition of the drawing action. In other words, the automation system is designed to preventively induce vibrations on the product being rolled in order to control the drawing action and prevent possible cobble situations, without waiting for them to occur, with the risk of not being able to intercept them in time.

The apparatus to control and adjust the drawing action according to the invention is therefore suitable to prevent possible cobble situations that can occur along the rolling mill, allowing to suitably modify the rolling parameters before potentially dangerous conditions occur.

Advantageously, the present apparatus to control and adjust the drawing action in a rolling mill, thanks to the video monitoring, processing and automation systems, can automatically detect the status of the product being rolled in any position whatsoever of the rolling mill, it can verify, quickly and effectively, if there are any risks of cobble for the product being rolled and it can transmit the data to the automation system of the rolling mill.

The automation system, in the event of a risks of cobble, can automatically intervene on one or more of the rolling parameters, for example motor revolutions and passage gaps between the rolling rolls, in order to modify the drawing action and prevent the risk of cobble, or stop it in its tracks.

Furthermore, the present apparatus allows to safeguard the safety of operators, limiting to the maximum, if not eliminating, manual operations, and allows to constantly display the rolling process in a workstation, for example the control console of the plant, together with the data processed by the system, in order to identify possible risks or potential criticalities of the process.

Furthermore, the present apparatus allows to contain production costs, drastically reduces the need for shutdowns of the rolling plant, thanks above all to the possibility of constantly verifying the status of the product being rolled, and therefore allows to intervene preemptively if there is a risk of cobble.

Furthermore, the present apparatus improves the management of the rolling process, reduces energy consumption by the drive means provided in the rolling stands, reduces the wear of the rolling rolls and at the same time minimizes the recovery times of the line in case of blocking.

According to another aspect of the invention, the video monitoring system can comprise at least one video camera located upstream and at least one video camera located downstream of each rolling stand.

The video monitoring system can comprise, for a same detection position, at least one video camera located according to a direction substantially perpendicular to the direction of rolling.

The video monitoring system can comprise, for a same detection position, a plurality of video cameras disposed according to different inclinations with respect to the direction of rolling.

The processing system can be connected to at least one display device able to allow to instantly verify the functioning of the rolling mill.

The processing system can be connected to one or more control systems outside the rolling mill and in which other data about the product being rolled can be processed.

The invention also concerns a method to control and adjust the drawing action in a rolling mill provided with a plurality of rolling stands disposed in sequence and through which a product being rolled passes in a direction of rolling.

The method comprises:

- determining an optimal condition of the drawing action for the product being rolled, corresponding to a condition of minimum oscillation of the product being rolled in at least one inter-stand segment;
- acquiring a sequence of frames of the product being rolled in at least one position along the rolling mill;
- processing this sequence of frames, wherein it is provided at least to define at least one normal rolling range, within which the product being rolled has to be positioned in a situation of normal rolling;
- identifying the position of the product being rolled and its geometric characteristics;
- identifying a possible oscillation of the product being rolled as a function of a variation of the position of the product being rolled over time based on the analysis of the sequence of frames acquired;
- sending the data relating to the position, or the possible variation of position, of the product being rolled to an automation system associated with the rolling mill, so that the automation system can determine the continuation of the rolling if the product is correctly positioned within the normal rolling range, or a possible variation of the rolling parameters if the position of the product being rolled is potentially able to generate a cobble, that is, it is outside of the range, in order to maintain or restore the optimal condition of the drawing action for the product being rolled.

According to some embodiments, in order to determine the optimal condition of the drawing action, the method provides to induce a set and controlled vibration on the product being rolled by applying controlled and timed accelerations and decelerations to the rolling stands, in particular to the motorized rolling rolls.

According to another aspect of the invention, the acquisition of a sequence of frames, for example by a determinate video camera, can take place before and after each rolling stand.

The processing of the sequence of frames can comprise operations such as the removal of the background from the frames, the removal of possible defects and/or disturbances from the frames, or other. For example, these operations can take place on frames acquired in successive moments by a same camera.

The method can comprise defining, on the frames detected, at least a pair of substantially horizontal lines that define the normal rolling range, wherein if the product being rolled goes beyond these lines there is a situation of potential blocking.

If the automation system modifies the drawing action applied to the rolling mill, at least one new cycle of controlling the drawing action can be carried out, in order to verify that the product being rolled is contained within the normal rolling range after the variation of the drawing action.

The variation of the drawing action applied to the product being rolled can comprise adjusting the rolling parameters such as adjusting the speed of one or more rolling stands, adjusting the passage gap of the product in one or more rolling stands, or other.

This method can also comprise:

- an initial step, under conditions of unknown drawing action, in which it is verified whether the product being rolled that passes between two consecutive rolling stands is vibrating or is not vibrating;
- if the product being rolled is not vibrating, at least one step of inducing a vibration on the product being rolled between two consecutive rolling stands, by increasing the speed of the rolling stand located upstream with respect to the speed of the rolling stand located downstream, wherein this increase in speed determines an increase in the flow rate and therefore the creation of a vibration between the two stands;
- at least one step of detecting the oscillations of the product being rolled with respect to the normal rolling range and possible correction of the rolling parameters in the rolling stand located upstream in order to keep the product in a desired oscillation within the range.

BRIEF DESCRIPTION OF THE DRAWINGS

These and other aspects, characteristics and advantages of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the possible embodiments of the invention, of which one or more examples are shown in the attached drawings. Each example is supplied by way of illustration of the invention and shall not be understood as a limitation thereof. For example, one or more characteristics shown or described insomuch as they are part of one embodiment can be varied or adopted on, or in association with, other embodiments to produce another embodiment. It is understood that the present invention shall include all such modifications and variants.

Figure 1:
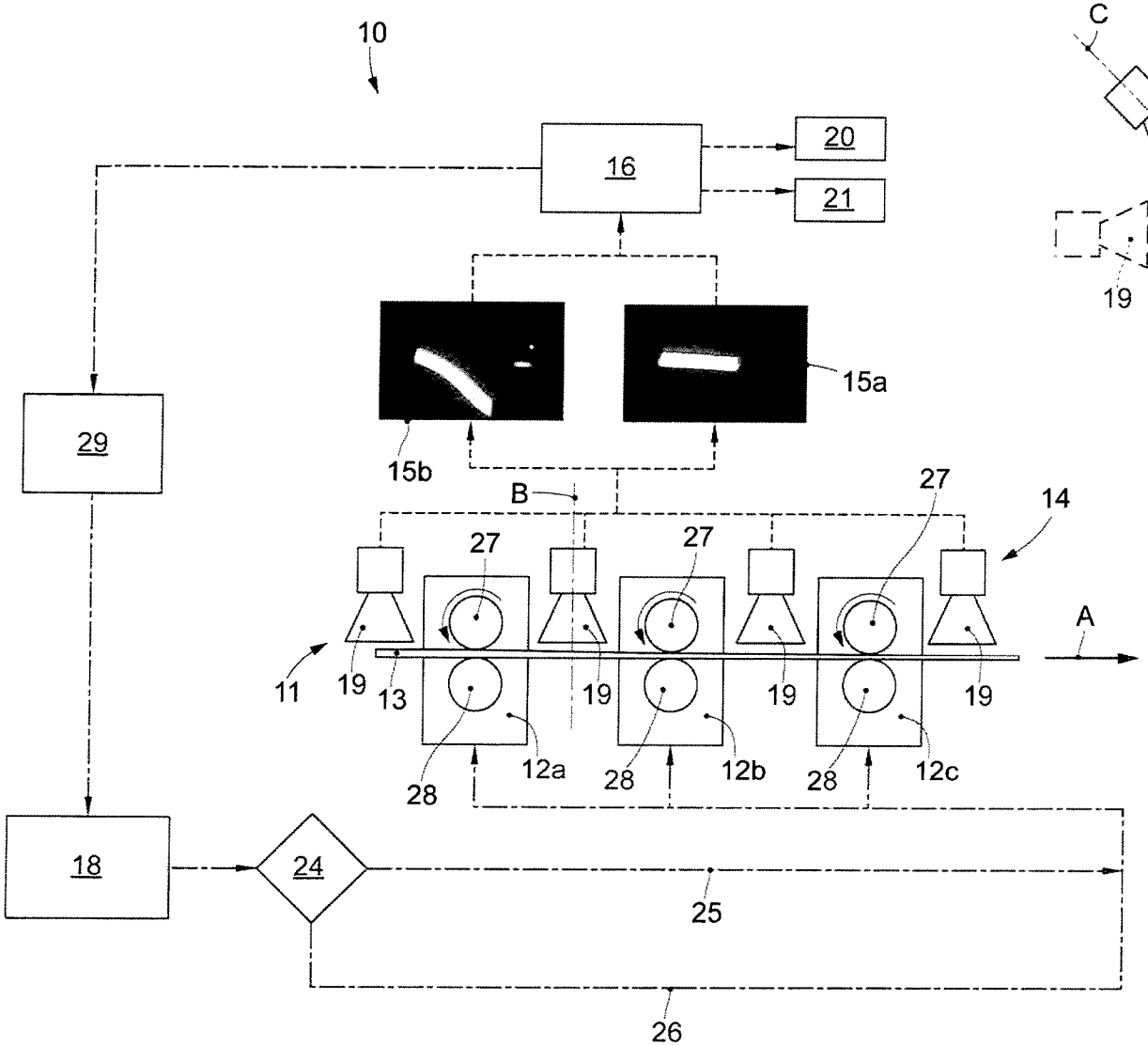
FIG. 1 is a schematic view of an apparatus according to the present invention to control and adjust the drawing action in a rolling mill.

With reference to the attached drawings, FIG. 1 schematically shows an apparatus 10 according to the present invention to adjust and control the drawing action in a rolling mill 11 provided with a plurality of rolling stands 12*a*, 12*b*, 12*c* disposed in sequence and through which a product 13 being rolled passes in a direction of rolling A.

Some embodiments described here also concern a rolling mill 11 comprising such apparatus 10.

The present apparatus 10 comprises:

a video monitoring system 14 for acquiring a sequence of frames 15*a*, 15*b*, 15*c* (see also FIGS. 3*a*, 3*b*, 3*c*) of the product 13 being rolled in at least one position along the rolling mill 11;

a processing system 16 connected to the video monitoring system 14 and configured to: carry out the processing of the sequence of frames 15*a*, 15*b*, 15*c* and define in this sequence of frames 15*a*, 15*b*, 15*c* acquired at least one normal rolling range 17 within which the product 13 being rolled has to be positioned in situations of normal rolling; identify the position of the product 13 being rolled and its geometric characteristics; identify a possible variation of the position of the product 13 being rolled over time based on the analysis of the sequence of frames 15*a*, 15*b*, 15*c* acquired;

an automation system 18, associated with the rolling mill 11, connected to the processing system 16 and configured to receive the data relating to the position of the product 13 being rolled, and the possible variation of position of the product 13 being rolled, so as to be able to determine the continuation of the rolling if the product is correctly positioned in the normal rolling range 17, or a possible variation of one or more of the rolling parameters if the position of the product 13 being rolled is potentially able to generate a cobble, that is, it is outside of the range 17.

In particular, the processing system 16, as a function of the variation of the position of the image of the product 13 being rolled in the frames 15*a*, 15*b*, 15*c* with respect to the normal rolling range 17, can identify an oscillation of the product 13 being rolled and possibly quantify the extent thereof.

According to some embodiments, the automation system 18 can be configured to determine an optimal condition of the drawing action for the product 13 being rolled corresponding to a condition of minimum and defined oscillation of the product 13 being rolled in at least one inter-stand segment, and determine the continuation of the rolling, or the variation of at least one rolling parameter, in order to maintain, or restore, the optimal condition of the drawing action determined.

According to some embodiments, the automation system 18 can be connected to the rolling stands 12*a*, 12*b*, 12*c*, and be configured to apply controlled timed accelerations and decelerations to at least two subsequent rolling stands 12*a*, 12*b*, 12*c* in order to impose set and controlled vibrations on the product 13 being rolled and control the condition of the drawing action thereof.

The video monitoring system 14 can comprise at least one video camera 19 for each inter-stand segment of the rolling mill 11 to which it has to be applied.

In particular, the video monitoring system 14 can comprise at least one video camera 19 located upstream of each rolling stand 12*a*, 12*b*, 12*c*, and at least one video camera 19 located downstream of each rolling stand 12*a*, 12*b*, 12*c*.

The monitoring system 14, therefore, is able to carry out photo or video detections in one or more determinate positions of the rolling mill 11, in order to have a complete picture of the rolling process.

The video cameras 19 are in particular configured to acquire a video sequence and/or a sequence of digital images, or frames, for example the frames 15*a*, 15*b*, 15*c*, in several positions of the rolling mill 11, in particular at entry and at exit of each rolling stand 12*a*, 12*b*, 12*c*. Naturally, the number of rolling stands and the distance between them can vary compared to what is schematically shown in FIG. 1.

The video monitoring system 14 can also comprise infrared devices, such as thermal imaging video cameras or suchlike, as an alternative to or in combination with the video cameras 19.

The product 13 being rolled has high temperatures, for example about 900-1200° C., therefore it has a high chromatic contrast with respect to the surrounding environment, and is clearly visible and detectable by the video monitoring system 14, provided with video cameras 19 and/or thermal imaging video cameras.

The video cameras 19 and/or the thermal imaging video cameras can be disposed in various positions with respect to the product 13 being rolled, and therefore with respect to the direction of rolling A.

For example, the video monitoring system 14 can comprise, for a same detection position, at least one video camera 19 according to a direction B substantially perpendicular to the direction of rolling A, see for example the video camera 19 located upstream of the rolling stand 12*b*. The positioning according to this direction B allows a better acquisition of the images of the product 13 being rolled.

Figure 2:
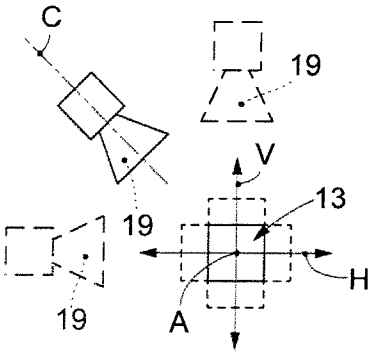
FIG. 2 is a front schematic view of a product being rolled.

The video monitoring system 14 can also comprise, for a same detection position, see FIG. 2, a plurality of video cameras 19 disposed according to different inclinations with respect to the direction of rolling A, and therefore substantially to the direction of longitudinal development of the product 13 being rolled.

These video cameras 19 can be disposed on the side of the product 13 being rolled, above the product being rolled or inclined with respect to the product being rolled. For example, it is possible to provide that the video monitoring system 14 comprises at least one video camera 19 located according to a direction C inclined by approximately 45° with respect to the direction of rolling A. In this way, it is possible to detect both possible lateral swerves of the product 13 being rolled, that is, swerves in a direction H that is horizontal with respect to the direction of rolling A, and also vertical swerves of the product 13 being rolled, that is, swerves in a direction V that is vertical with respect to the direction of rolling A.

The provision of several video cameras 19 in the same detection position, as shown schematically in FIG. 2, allows to send to the processing system 16 a series of frames from different angles, and therefore allows to obtain multiple readings of the situation of the product 13 being rolled, allowing in fact to better define the characteristics of the product 13.

For example, it is possible to use the geometric data of the product 13 detected by the video monitoring system 14 to carry out a measurement of the sizes thereof in the various rolling passes. Therefore, it is possible to determine, in each pass, width, thickness and other possible parameters of the product 13.

This processing system 16 can be connected to at least one display device 20, for example a pulpit or suchlike, able to allow operators to instantly check the functioning of the rolling mill 11. Furthermore, on this display device 20 there can be projected the data detected and processed by the processing system 16 relating to the status of the product 13 being rolled in the various steps of the rolling process.

The processing system 16 can be connected to one or more control systems 21 outside the rolling mill 11 and in which other data about the product 13 being rolled can be processed. These other control systems 21 can be, for example, control rooms for use, for example, by technologists.

The method to control and adjust the drawing action according to the invention substantially comprises the following steps:

- acquiring a sequence of frames 15*a*, 15*b*, 15*c*, of the product 13 being rolled in at least one position along the rolling mill 11;
- processing the sequence of frames 15*a*, 15*b*, 15*c*, wherein it is provided at least to define, in the sequence of frames 15*a*, 15*b*, 15*c* acquired, at least one normal rolling range 17 within which the product being rolled has to be positioned in a situation of normal rolling;
- identifying the position of the product 13 being rolled and its geometric characteristics;
- identifying a possible variation of the position of the product 13 being rolled over time based on the analysis of the sequence of frames 15*a*, 15*b*, 15*c* acquired;
- sending the data relating to the position of the product 13 being rolled, and the possible variation of the position of the product 13 being rolled, to an automation system 18 associated with the rolling mill 11, so that the automation system 18 can determine the continuation of the rolling if the product 13 is correctly positioned within the normal rolling range 17, or a possible variation of one or more of the rolling parameters if the position of the product 13 being rolled is potentially able to generate a cobble, that is, it is outside of the range 17.

According to some embodiments, the method provides to determine an optimal condition of the drawing action for the product 13 being rolled, corresponding to a condition of minimum oscillation of the product 13 being rolled in at least one inter-stand segment, and determine the continuation of the rolling, or the variation of one or more rolling parameters, in order to maintain or restore the optimal condition of the drawing action.

According to some embodiments, in order to determine the optimal condition of the drawing action, the method provides to induce a set and controlled vibration on the product 13 being rolled by applying controlled and timed accelerations and decelerations to the rolling stands 12*a*, 12*b*, 12*c*, as will be better described below.

In particular, the accelerations and decelerations can be uniformly timed over time in order to pass from a situation of drawing action to a situation of thrust action for a defined time, so as to make the product 13 being rolled pass from a situation of linear progress to a situation in which it is induced to vibrate. The video monitoring system 14 can then record these set and controlled vibrations in order to determine whether or not their amplitude is recurring and the images of the product 13 in the frames 15*a*, 15*b*, 15*c* acquired fall within the normal rolling ranges 17 or whether they take positions outside of them.

Preferably, the acquisition of a sequence of frames 15*a*, 15*b*, 15*c* takes place before and after each rolling stand 12*a*, 12*b*, 12*c*.

The step of processing this sequence of frames 15*a*, 15*b*, 15*c* can be carried out by means of suitable algorithms and can comprise operations such as the removal of the background from the frames 15*a*, 15*b*, 15*c*, the removal of possible defects and/or disturbances from the frames 15*a*, 15*b*, 15*c*, for example drops, reflections, or other.

Figure 3A:
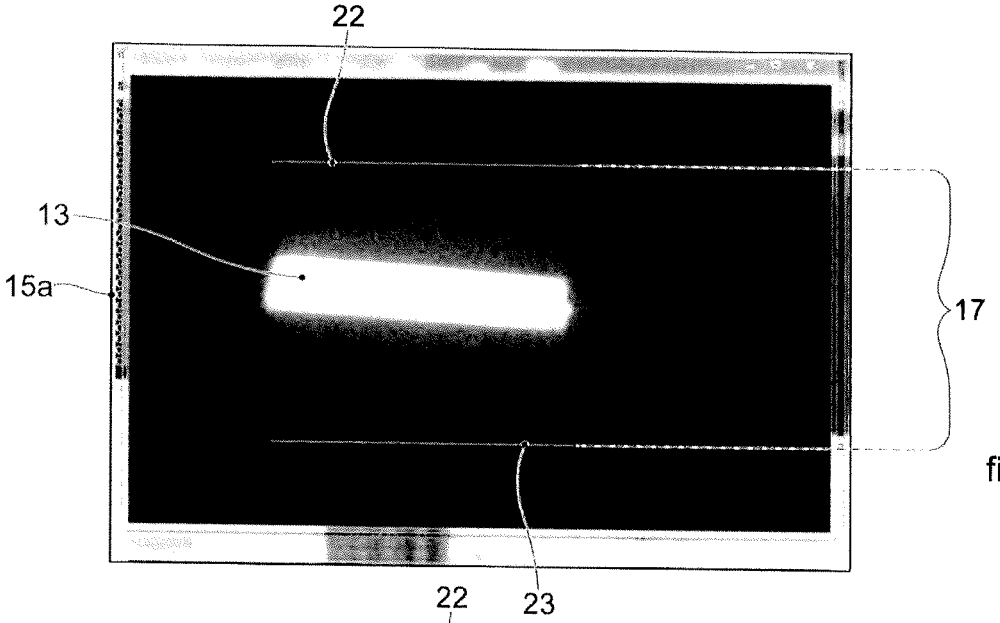
FIGS. 3*a*, 3*b* and 3*c* schematically show three frames of a product being rolled.
Figure 3B:
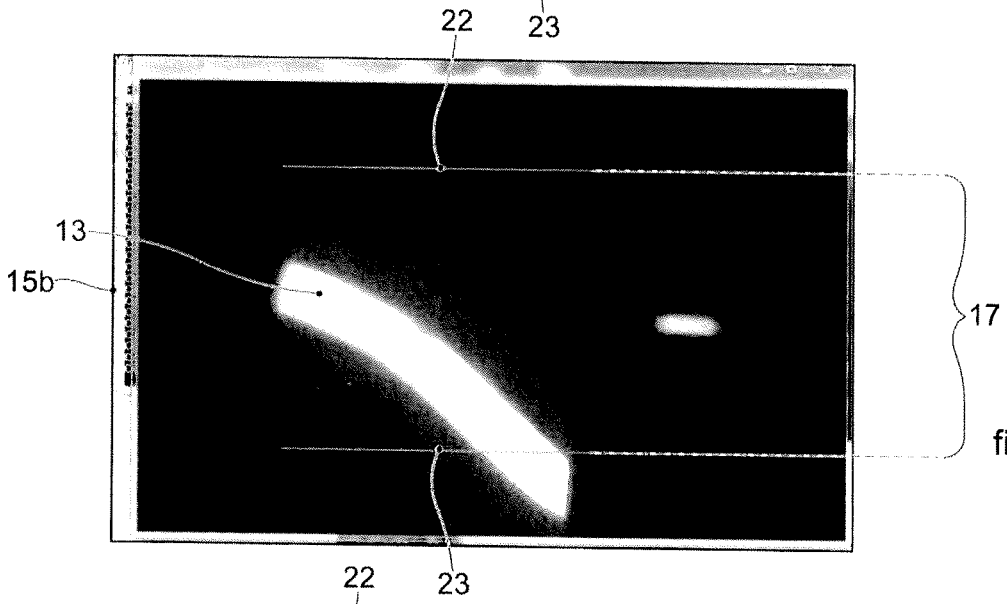

In particular, on the frames detected, consider for example the frame 15*a* of FIG. 3*a*, which substantially represents a frame of a recording carried out by means of one of the video cameras 19, there is defined at least a pair of substantially horizontal lines 22 and 23 which define the normal rolling range 17, for example in a central zone of the frame 15*a*. If the product 13 being rolled goes beyond these lines 22, 23 there is a situation of potential blocking.

For example, see FIG. 2*b*, when the position of the product 13 goes beyond one of the limits of the range 17, that is, one of the lines 22 or 23, the rolling mill 11 goes into emergency. Tolerances can clearly be provided before the emergency actually comes into operation: for example, the percentage of pixels of the product 13 beyond the range 17, compared to the percentage of pixels that have not gone beyond it, or if the product 13 remains beyond the range 17, on one side or the other, for a certain period of time, or if it goes beyond it and re-enters it for a number of times in a certain time. Furthermore, for different rolling passes and products of different shapes, the positioning of the normal rolling range 17 can change, that is, the positions of the lines 22 and 23 can change.

Figure 3C:
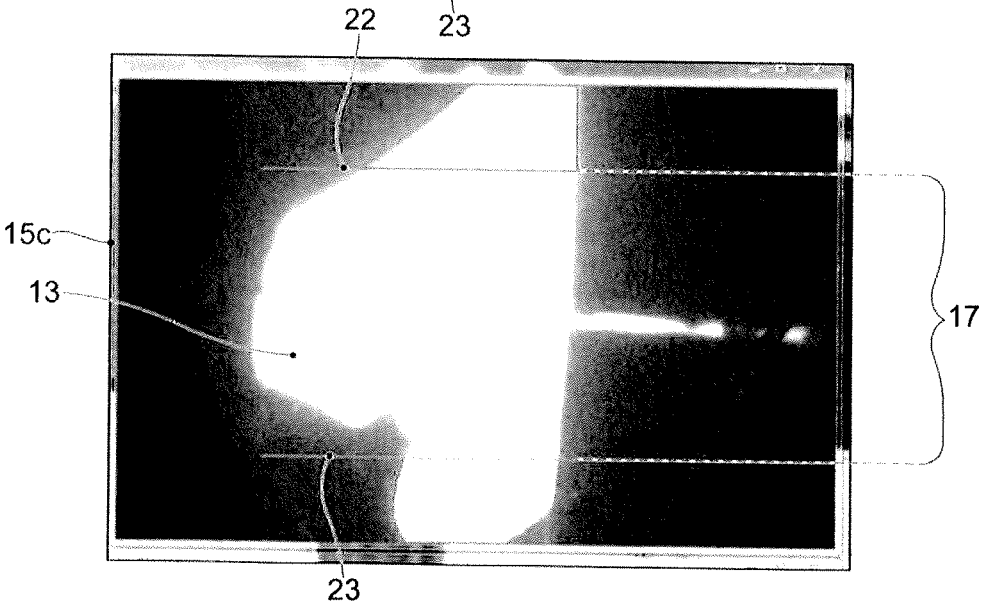

When the emergency is definite, see frame 15*c* in FIG. 3*c*, the emergency procedure is implemented, which normally provides scrapping the product 13 upstream by means of special shears and/or stopping the rolling stands in which the cobble occurred.

The situation of potential cobble, following for example the detection of a sequence of frames 15*b*, can generate a state of alarm of the rolling mill 11, which can provide, as a consequence, the adjustment of the drawing action by the automation system 18, see for example the decision node 24 in the diagram of FIG. 1.

The processing system 16 sends a series of data extrapolated from the images or frames acquired, block 29, which comprise the data relating for example to the frames 15*a*, 15*b*, 15*c*.

Substantially, if the processing system 16 sends to the automation system 18 the data relating to a sequence of frames 15*a* in which the product 13 is stably contained within the range 17, the rolling continues with the current parameters, see line 25. On the other hand, if the processing system 16 sends to the automation system 18 the data relating to a sequence of frames 15*b*, then the rolling mill 11 enters an emergency situation and the automation system 18 varies one or more of the rolling parameters in one or more of the rolling stands 12*a*, 12*b*, 12*c* involved in the potential cobble, see line 26.

If the automation system 18 modifies the status of the rolling mill 11, at least one new cycle of controlling the drawing action is carried out in order to verify that the product 13 being rolled is contained within the normal rolling range 17, after the variation. This control cycle can be repeated until parameters of the drawing action are identified that are suitable to determine a correct rolling with the product 13 within the range 17.

The variation of the rolling parameters with the purpose of possibly adjusting the drawing action of the product 13 being rolled can comprise, for example, one or more of either adjusting the speed of one or more rolling stands 12*a*, 12*b*, 12*c*, adjusting the passage gap of the product 13 in one or more rolling stands 12*a*, 12*b*, 12*c*, or other.

Each rolling stand 12*a*, 12*b*, 12*c* comprises at least one pair of rolls 27, 28 of which at least one roll is motorized and rotates according to a determinate speed of rotation, for example the roll 27. The rolls 27 and 28 can in any case both be advantageously motorized.

If only the roll 27 is motorized, the other roll 28 can be a support roll, for example an idle roll dragged at the same speed as the roll 27 by the product 13. With the term speed of the rolling stand we therefore mean the speed of rotation of the rolls 27, 28 of the rolling stand 12*a*, 12*b*, 12*c*.

Figure 4A:
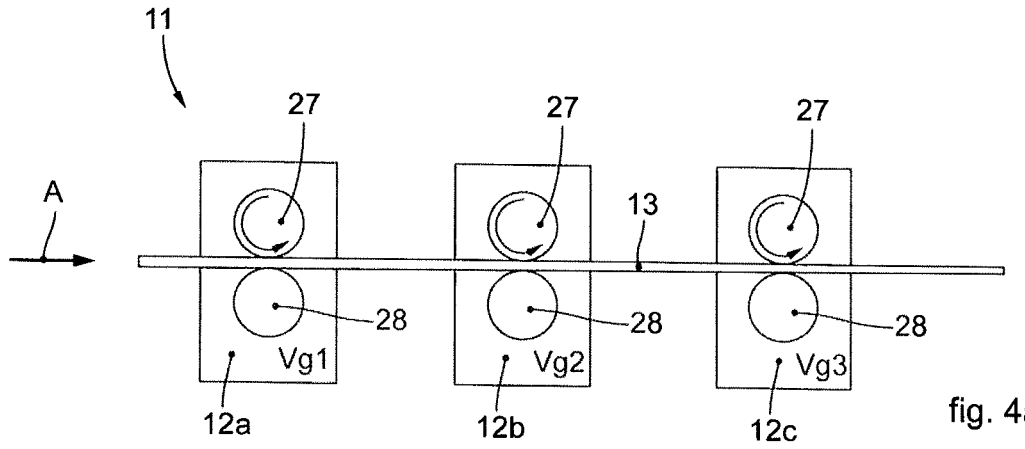
FIGS. 4*a*, 4*b* and 4*c* show some steps of the present method to control and adjust the drawing action in a rolling mill.
Figure 4B:
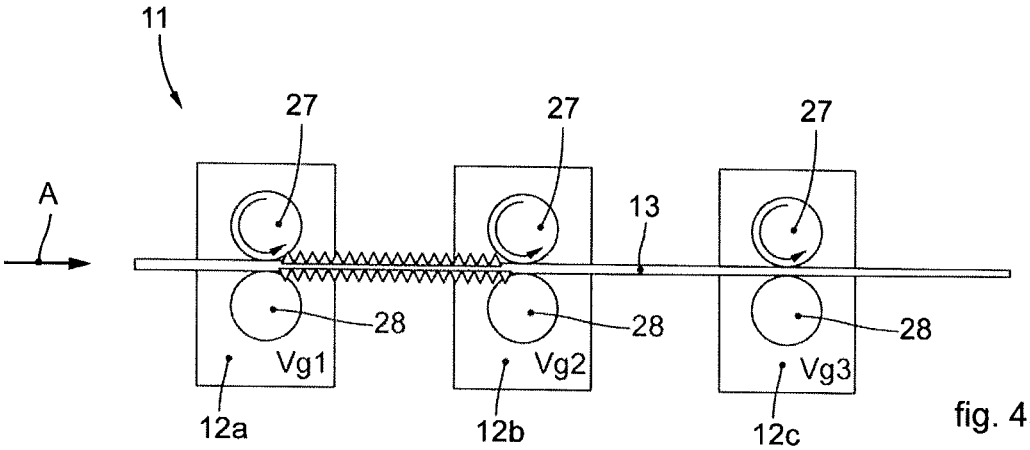
Figure 4C:
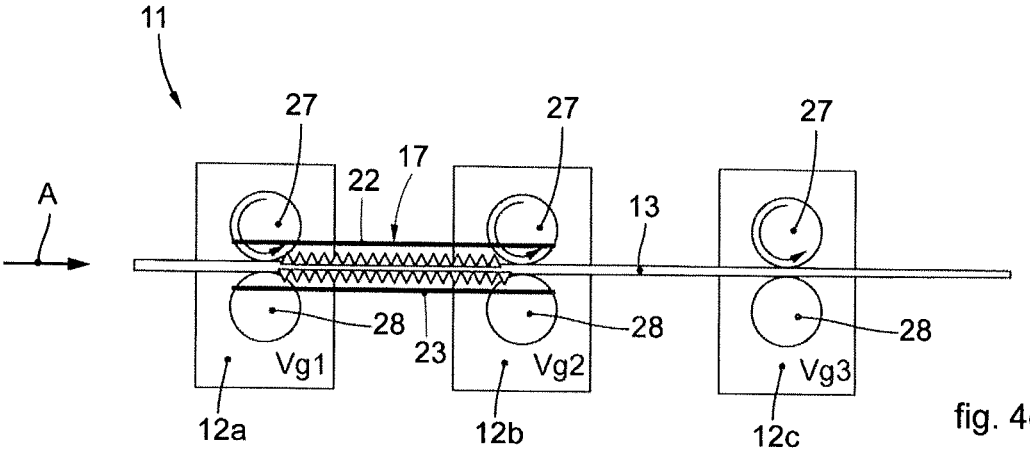

In the sequence shown in FIGS. 4*a*, 4*b*, 4*c*, the speed of the three rolling stands 12*a*, 12*b*, 12*c* has been indicated respectively with Vg1, Vg2, Vg3.

The control of the drawing action, according to the sequence of FIGS. 4*a*, 4*b*, 4*c*, comprises:

an initial step in which it is verified whether the product 13 being rolled that passes between two consecutive rolling stands is vibrating or is not vibrating;

if the product being rolled 13 is not vibrating, at least one step of inducing a vibration on the product 13 being rolled between two consecutive rolling stands, for example the rolling stands 12*a*, 12*b*, see FIG. 4*b*, by increasing the speed Vg1 of the rolling stand 12*a* located upstream with respect to the speed Vg2 of the rolling stand 12*b* located downstream, so that the flow rate of product that passes in the rolling stand 12*a* located upstream is increased as a result of the vibration induced;

at least one step of detecting the oscillations of the product 13 being rolled with respect to the normal rolling range 17, delimited for example by the lines 22 and 23, and possible correction of the rolling parameters in the rolling stand 12*a* located upstream in order to keep the product 13 in a desired oscillation within the range 17.

The adjustment of the rolling parameters in a rolling stand 12*a* can provide, for example, an adjustment of the speed Vg1 in such rolling stand and/or a variation of the passage gap of the product 13 between the rolling rolls 27 and 28.

Substantially, therefore, it is possible that in the rolling mill 11 there is an initial condition of vibration of the product 13, for example due to an insufficient drawing action, which may or may not be contained within the range 17. It can also occur that there is no initial vibration of the product 13, for example in the case of a drawing action in optimal conditions or in the case of an excess of drawing action.

Therefore, in order to correctly apply the drawing action in the various steps of the rolling process, if the product 13 has an initial vibration, the parameters of the rolling stand 12*a* located upstream are controlled in order to set the oscillation or vibration to the desired value, therefore maintain the vibration within the range 17. Otherwise, if the product 13 does not have an initial vibration, it is possible to proceed, for example periodically, with inducing a vibration in the product 13 and therefore control the rolling parameters.

Periodically, therefore, for a defined time and for each pair of rolling stands located in sequence, for example the rolling stands 12*a* and 12*b*, the rolling stand 12*a* located upstream is accelerated slightly: this causes a greater passage of material (same section at higher speed, therefore higher flow rate) toward the subsequent rolling stand 12*b*. This subsequent rolling stand 12*b* struggles to accommodate the excess material and hence a vibration is generated. This vibration is detected and processed by the present video monitoring apparatus 10, with the following result: if the product 13 remains within the range 17, the process continues, if it is outside there is the risk of cobble and the rolling process can be stopped.

Substantially, if there is no wear of the rolling channels in a determinate rolling stand, the excess flow will cause a low vibration, which will not go beyond the range 17. Conversely, if due to wear the gap defined by the rolling channels is excessive, the over-speed induced would be added to the over-section deriving from wear, causing an excessive flow rate which would cause the range 17 to be exceeded. Therefore, the present method and the present apparatus are extremely effective in determining the status of the rolling stands.

It is clear that modifications and/or additions of parts and steps may be made to the apparatus and method as described heretofore, without departing from the field and scope of the present invention as defined by the claims.

It is also clear that, although the present invention has been described with reference to some specific examples, a person of skill in the art shall certainly be able to achieve many other equivalent forms of apparatus and method, having the characteristics as set forth in the claims and hence all coming within the field of protection defined thereby. In the following claims, the sole purpose of the references in brackets is to facilitate reading: they must not be considered as restrictive factors with regard to the field of protection claimed in the specific claims.

The invention claimed is:

1. An apparatus to control and adjust a drawing action in a rolling mill (11) provided with a plurality of rolling stands (12*a*, 12*b*, 12*c*) located in sequence through which a product (13) being rolled passes in a direction of rolling (A), comprising:

a video monitoring system (14) for acquiring a sequence of frames (15*a*, 15*b*, 15*c*) of the product (13) being rolled while the product (13) being rolled is positioned, during use, in at least one position along the rolling mill (11);

a processing system (16), connected to the video monitoring system (14) and configured to: carry out processing of the sequence of frames (15*a*, 15*b*, 15*c*) and define in the sequence of frames (15*a*, 15*b*, 15*c*) at least one normal rolling range (17) wherein the product (13) being rolled has to be positioned within the at least one normal rolling range (17) in a situation of normal rolling; identify a position of the product (13) being rolled and a geometric characteristic of the product (13) being rolled; identify an oscillation of the product (13) being rolled as a function of a variation of the position of the product (13) being rolled over time with respect to the at least one normal rolling range (17) based on an analysis of the sequence of frames (15*a*, 15*b*, 15*c*);

an automation system (18) associated with the rolling mill (11), connected to the processing system (16) and configured to determine an optimal condition of the drawing action for the product (13) being rolled corresponding to a condition of minimum oscillation of the product (13) being rolled in at least one inter-stand segment and to receive data relating to the position of the product (13) being rolled and of the variation of the position of the product (13) being rolled, so as to be able to determine a continuation of rolling if the product (13) is correctly positioned in the at least one normal rolling range (17), and to determine a variation of at least one rolling parameter if the position of the product (13) being rolled is outside of the at least one normal rolling range (17), in order to maintain or restore the optimal condition of the drawing action in the at least one inter-stand segment, wherein the automation system is configured to verify, as an initial step, under conditions of unknown drawing action, whether the product (13) being rolled passing between two consecutive rolling stands is vibrating or is not vibrating; and if the product (13) being rolled is not vibrating, to induce a vibration of the product being rolled between two consecutive rolling stands (12*a*, 12*b*, 12*c*), by increasing a speed (Vg1) of a rolling stand located upstream with respect to a speed (Vg2) of a rolling stand located downstream, wherein increasing the speed (Vg1) determines an increase in a flow rate and a creation of the vibration between the two consecutive rolling stands; and wherein the automation system is configured to detect the oscillation of the product (13) being rolled with respect to the at least one normal rolling range (17) and to correct the at least one rolling parameter in the rolling stand located upstream to keep the product in a desired oscillation within the at least one normal rolling range (17).

2. The apparatus as in claim 1, wherein the automation system (18) is configured to apply controlled timed accelerations and decelerations to at least one motorized roll (27, 28) of at least two rolling stands of the plurality of rolling stands (12*a*, 12*b*, 12*c*) to impose set and controlled vibrations on the product (13) being rolled.

3. The apparatus as in claim 1, wherein the video monitoring system (14) comprises at least one video camera (19) for each inter-stand segment of the rolling mill (11) located, during use, upstream and/or downstream of each rolling stand of the plurality of rolling stands (12*a*, 12*b*, 12*c*).

4. The apparatus as in claim 1, wherein the video monitoring system (14) comprises, for a same detection position, at least one video camera (19) located according to a direction (B) substantially perpendicular to the direction of rolling (A).

5. The apparatus as in claim 1, wherein the video monitoring system (14) comprises, for a same detection position, a plurality of video cameras (19) disposed according to different inclinations with respect to the direction of rolling (A).

6. The apparatus as in claim 1, wherein the video monitoring system (14) comprises at least one video camera (19) located in a direction (C) inclined by about 45° with respect to the direction of rolling (A).

7. The apparatus as in claim 1, wherein the processing system (16) is connected to at least one display device (20) able to instantly verify a functioning of the rolling mill (11).

8. The apparatus as in claim 1, wherein the processing system (16) is connected to one or more control systems (21) outside the rolling mill (11) and in which data about the product (13) being rolled can be processed.

9. A rolling mill comprising:

an apparatus to control and adjust a drawing action in a rolling mill (11) provided with a plurality of rolling stands (12*a*, 12*b*, 12*c*) located in sequence through which a product (13) being rolled passes in a direction of rolling (A), comprising:

a video monitoring system (14) for acquiring a sequence of frames (15*a*, 15*b*, 15*c*) of the product (13) being rolled while the product (13) being rolled is positioned, during use, in at least one position along the rolling mill (11);

a processing system (16), connected to the video monitoring system (14) and configured to: carry out processing of the sequence of frames (15*a*, 15*b*, 15*c*) and define in the sequence of frames (15*a*, 15*b*, 15*c*) at least one normal rolling range (17) wherein the product (13) being rolled has to be positioned within the at least one normal rolling range (17) in a situation of normal rolling; identify a position of the product (13) being rolled and a geometric characteristic of the product (13) being rolled; identify an oscillation of the product (13) being rolled as a function of a variation of the position of the product (13) being rolled over time with respect to the at least one normal rolling range (17) based on an analysis of the sequence of frames (15*a*, 15*b*, 15*c*);

an automation system (18) associated with the rolling mill (11), connected to the processing system (16) and configured to determine an optimal condition of the drawing action for the product (13) being rolled corresponding to a condition of minimum oscillation of the product (13) being rolled in at least one inter-stand segment and to receive data relating to the position of the product (13) being rolled and of the variation of the position of the product (13) being rolled, so as to be able to determine a continuation of rolling if the product (13) is correctly positioned in the at least one normal rolling range (17), and to determine a variation of at least one rolling parameter if the position of the product (13) being rolled is outside of the at least one normal rolling range (17), in order to maintain or restore the optimal condition of the drawing action in the at least one inter-stand segment, wherein the automation system is configured to verify, as an initial step, under conditions of unknown drawing action, whether the product (13) being rolled passing between two consecutive rolling stands is vibrating or is not vibrating; and if the product (13) being rolled is not vibrating, to induce a vibration of the product being rolled between two consecutive rolling stands (12*a*, 12*b*, 12*c*), by increasing a speed (Vg1) of a rolling stand located upstream with respect to a speed (Vg2) of a rolling stand located downstream, wherein increasing the speed (Vg1) determines an increase in a flow rate and a creation of the vibration between the two consecutive rolling stands;

wherein the automation system is configured to detect the oscillation of the product (13) being rolled with respect to the at least one normal rolling range (17) and to correct the at least one rolling parameter in the rolling stand located upstream to keep the product in a desired oscillation within the at least one normal rolling range (17); and wherein the product (13) is a long product.

10. A method to control and adjust a drawing action in a rolling mill (11) provided with a plurality of rolling stands (12*a*, 12*b*, 12*c*) located in sequence through which a product (13) being rolled passes in a direction of rolling (A), the method comprising:

determining an optimal condition of the drawing action for the product (13) being rolled, corresponding to a condition of minimum oscillation of the product (13) being rolled in at least one inter-stand segment;

acquiring a sequence of frames (15*a*, 15*b*, 15*c*) of the product (13) being rolled in at least one position along the rolling mill (11);

processing the sequence of frames (15*a*, 15*b*, 15*c*), wherein the processing includes defining, in the sequence of frames (15*a*, 15*b*, 15*c*), at least one normal rolling range (17) wherein the product (13) being rolled has to be positioned in a situation of normal rolling;

identifying a position of the product (13) being rolled and geometric characteristics of the product (13) being rolled;

identifying an oscillation of the product (13) being rolled as a function of a variation of the position of the product (13) being rolled over time based on an analysis of the sequence of frames (15*a*, 15*b*, 15*c*) acquired;

sending data relating to the position of the product (13) being rolled and the variation of the position of the product (13) being rolled to an automation system (18) associated with the rolling mill (11), so that the automation system (18) can determine a continuation of the rolling if the product (13) is correctly positioned within the at least one normal rolling range (17) or a variation of at least one rolling parameter if the position of the product (13) being rolled is outside of the at least one normal rolling range (17), in order to maintain or restore the optimal condition of the drawing action for the product (13) being rolled;

verifying, as an initial step, under conditions of unknown drawing action, whether the product (13) being rolled that passes between two consecutive rolling stands is vibrating or is not vibrating;

if the product (13) being rolled is not vibrating, at least one step of inducing a vibration on the product being rolled between two consecutive rolling stands (12*a*, 12*b*, 12*c*), by increasing a speed (Vg1) of a rolling stand located upstream with respect to a speed (Vg2) of a rolling stand located downstream, wherein increasing the speed (Vg1) determines an increase in a flow rate and a creation of a vibration between the two consecutive rolling stands;

at least one step of detecting the oscillation of the product (13) being rolled with respect to the at least one normal rolling range (17) and correcting the at least one rolling parameter in the rolling stand located upstream in order to keep the product in a desired oscillation within the at least one normal rolling range (17).

11. The method as in claim 10, wherein in order to determine the optimal condition of the drawing action it provides to induce a set and controlled vibration on the product (13) being rolled by applying controlled and timed accelerations and decelerations to the rolling stands (12*a*, 12*b*, 12*c*).

12. The method as in claim 10, wherein the acquiring the sequence of frames (15*a*, 15*b*, 15*c*) occurs before and/or after each rolling stand (12*a*, 12*b*, 12*c*).

13. The method as in claim 10, wherein the processing of the sequence of frames (15*a*, 15*b*, 15*c*) comprises at least one of removal of a background from the frames (15*a*, 15*b*, 15*c*), or removal of defects, or removal of disturbances from the frames (15*a*, 15*b*, 15*c*).

14. The method as in claim 10, comprising: a definition on the sequence of detected frames (15*a*, 15*b*, 15*c*) of at least a pair of substantially horizontal lines (22, 23) which define the at least one normal rolling range (17), wherein if the product (13) being rolled goes beyond the lines (22, 23) there is a situation of potential blocking.

15. The method as in claim 10, wherein if the automation system (18) changes at least one rolling parameter of the rolling mill (11), at least one new control cycle of the drawing action is carried out, so as to verify that the product (13) being rolled is contained within the at least one normal rolling range (17) after the variation of the drawing action.

16. The method as in claim 10, wherein the variation of the drawing action applied to the product (13) being rolled comprises adjusting the rolling parameters adjusting a speed (Vg1, Vg2, Vg3) of one or more rolling stands (12*a*, 12*b*, 12*c*), adjusting a passage gap of the product (13) in one or more rolling stands (12*a*, 12*b*, 12*c*).

* * * * *